US010882053B2

(12) United States Patent
Krichtafovitch

(10) Patent No.: US 10,882,053 B2
(45) Date of Patent: Jan. 5, 2021

(54) ELECTROSTATIC AIR FILTER

(71) Applicant: Pacific Air Filtration Holdings, LLC, Boulder, CO (US)

(72) Inventor: Igor Krichtafovitch, Kiev (UA)

(73) Assignee: Agentis Air LLC, Columbia, MD (US)

( * ) Notice: Subject to any disclaimer, the term of this patent is extended or adjusted under 35 U.S.C. 154(b) by 0 days.

(21) Appl. No.: 16/309,885

(22) PCT Filed: Jun. 13, 2017

(86) PCT No.: PCT/US2017/037317

§ 371 (c)(1),
(2) Date: Dec. 13, 2018

(87) PCT Pub. No.: WO2017/218582

PCT Pub. Date: Dec. 21, 2017

(65) Prior Publication Data

US 2019/0351431 A1 Nov. 21, 2019

Related U.S. Application Data

(63) Continuation-in-part of application No. 15/182,583, filed on Jun. 14, 2016, now abandoned.

(51) Int. Cl.
*B03C 3/12* (2006.01)
*B03C 3/41* (2006.01)
(Continued)

(52) U.S. Cl.
CPC ..... *B03C 3/12* (2013.01); *B03C 3/41* (2013.01); *B03C 3/47* (2013.01); *B03C 3/86* (2013.01); *B03C 2201/04* (2013.01)

(58) Field of Classification Search
CPC combination set(s) only.
See application file for complete search history.

(56) References Cited

U.S. PATENT DOCUMENTS 1,650,097 A 11/1927 Schmidt
1,931,436 A 10/1933 Walther
(Continued)

FOREIGN PATENT DOCUMENTS

CN 2319732 5/1999
CN 1926651 A 3/2007
(Continued)

OTHER PUBLICATIONS

Wen, T., Wang, H., Krichtofovich, I., Mamishev, A., Novel Electrodes of an Electrostatic Precipitator for Air Filtration, submitted to Journal of Electronics Nov. 12, 2014, Seattle, Washington.

*Primary Examiner* — Frank M Lawrence, Jr.
*Assistant Examiner* — Sonji Turner
(74) *Attorney, Agent, or Firm* — Ungerman IP PLLC; Mark E. Ungerman

(57) ABSTRACT

An electronic air filter having a plurality of electrodes supported by rigid fixtures that are attached to a common case. The rigid fixtures that support the electrodes with different electrical potentials are attached to each other or to a common body in a way that increases or maximizes the creeping discharge path along the surface. Even conductive contaminants do not, therefore, provide an electrical shortage between the electrodes.

6 Claims, 8 Drawing Sheets

(51) Int. Cl.
*B03C 3/86* (2006.01)
*B03C 3/47* (2006.01)

(56) References Cited

U.S. PATENT DOCUMENTS 1,957,560 A 5/1934 Thompson
2,142,129 A 1/1939 Wilhelm et al.
2,271,597 A 2/1942 Lionel
2,526,402 A 10/1950 Palmer
2,571,079 A * 10/1951 Warburton ..... B03C 3/40 96/67
2,588,111 A * 3/1952 Hanneman ..... B03C 3/45 204/668
2,672,207 A * 3/1954 Hedberg ..... B03C 3/45 96/85
2,771,963 A 11/1956 Warren
2,997,130 A 8/1961 Nodolf
3,040,497 A 6/1962 Schwab
3,157,479 A 11/1964 Boles
3,504,482 A 4/1970 Goettl
3,518,462 A 6/1970 Brown
3,710,588 A 1/1973 Martinez
3,816,980 A 6/1974 Schwab
3,831,351 A 8/1974 Gibbs et al.
3,959,715 A 5/1976 Canning
3,960,505 A 6/1976 Marks
4,057,405 A 11/1977 Cheney et al.
4,077,785 A 3/1978 Hartshorn
4,098,591 A 7/1978 Diepenbroek et al.
4,124,359 A * 11/1978 Geller ..... B03C 3/40 96/65
4,160,202 A 7/1979 James et al.
4,166,729 A 9/1979 Thompson et al.
4,177,047 A 12/1979 Goland
4,178,156 A 12/1979 Tashiro et al.
4,231,766 A 11/1980 Spurgin
4,246,010 A 1/1981 Honacker
4,259,093 A 3/1981 Vlastos et al.
4,259,707 A 3/1981 Penney
4,264,343 A 4/1981 Natarajan et al.
4,290,003 A 9/1981 Lanese
4,390,830 A 6/1983 Laugesen
4,390,831 A 6/1983 Byrd et al.
4,433,281 A 2/1984 Herklotz et al.
4,486,704 A 12/1984 Gustafsson et al.
4,490,159 A 12/1984 Malts
4,516,991 A 5/1985 Kawashima
4,549,887 A 10/1985 Joannou
4,604,112 A 8/1986 Ciliberti et al.
4,613,346 A 9/1986 Reyes et al.
4,643,745 A 2/1987 Sakakibara et al.
4,673,416 A 6/1987 Sakakibara et al.
4,689,056 A 8/1987 Noguchi et al.
4,719,535 A 1/1988 Zhenjun et al.
4,904,283 A 2/1990 Hovis et al.
4,980,796 A 12/1990 Huggins
5,035,728 A 7/1991 Fang
5,068,811 A 11/1991 Johnston et al.
5,108,470 A 4/1992 Pick
5,123,524 A * 6/1992 Lapeyre ..... B65G 17/08 198/853
5,251,171 A 10/1993 Yamauchi
5,254,155 A 10/1993 Mensi
5,330,559 A 7/1994 Cheney et al.
5,332,485 A * 7/1994 Thompson ..... B01D 35/06 204/665
5,332,562 A 7/1994 Kersey et al.
5,336,299 A 8/1994 Savell
5,395,430 A 3/1995 Lundgren et al.
5,466,279 A 11/1995 Hattori et al.
5,526,402 A 6/1996 Dent et al.
5,573,577 A 11/1996 Joannou
5,628,818 A 5/1997 Smith et al.
5,679,121 A 10/1997 Kim
5,689,177 A 11/1997 Nielsen et al.
5,707,428 A 1/1998 Feldman et al.
5,807,425 A 9/1998 Gibbs
5,827,407 A 10/1998 Wang et al.
5,846,302 A 12/1998 Putro
5,914,454 A 6/1999 Imbaro et al.
5,922,111 A 7/1999 Omi et al.
5,993,521 A 11/1999 Loreth et al.
6,129,781 A 10/2000 Okamoto et al.
6,187,271 B1 2/2001 Lee et al.
6,245,131 B1 6/2001 Rippelmeyer et al.
6,251,171 B1 6/2001 Marra et al.
6,504,308 B1 1/2003 Krichtafovitch et al.
6,527,834 B1 3/2003 Jörder et al.
6,635,106 B2 10/2003 Katou et al.
6,656,248 B2 12/2003 Ilmasti
6,660,061 B2 12/2003 Josephson et al.
6,764,533 B2 7/2004 Lobiondo
6,790,259 B2 9/2004 Rittri et al.
6,805,732 B1 10/2004 Billiotte et al.
6,831,271 B1 12/2004 Guevremont et al.
6,888,314 B2 5/2005 Krichtafovitch et al.
6,937,455 B2 8/2005 Krichtafovitch et al.
6,984,987 B2 1/2006 Taylor et al.
7,008,469 B2 3/2006 Vetter et al.
7,019,244 B2 3/2006 Weaver et al.
7,048,780 B2 5/2006 Kim et al.
7,112,238 B2 9/2006 Joannou
7,150,780 B2 12/2006 Krichtafovitch et al.
7,163,572 B1 1/2007 Liang et al.
7,182,805 B2 2/2007 Reaves
7,264,659 B1 9/2007 Moshenrose
7,316,735 B2 1/2008 Tomimatsu et al.
7,332,019 B2 2/2008 Bias et al.
7,351,274 B2 4/2008 Helt et al.
7,393,385 B1 7/2008 Coffey et al.
7,431,755 B2 10/2008 Kobayashi et al.
7,438,743 B2 10/2008 Strauss
7,452,410 B2 11/2008 Bergeron et al.
7,513,933 B2 4/2009 Coppom et al.
7,531,027 B2 5/2009 Tepper et al.
7,531,028 B2 5/2009 Mello et al.
7,534,288 B2 5/2009 Bromberg
7,553,353 B2 6/2009 Lepage
7,569,100 B2 8/2009 Tanaka et al.
7,582,144 B2 9/2009 Krigmont
7,582,145 B2 9/2009 Krigmont
7,594,958 B2 9/2009 Krichtafovitch et al.
7,597,750 B1 10/2009 Krigmont
7,608,135 B2 10/2009 Mello et al.
7,652,431 B2 1/2010 Krichtafovitch
7,717,980 B2 5/2010 Tepper et al.
7,736,418 B2 6/2010 Graβ
7,753,994 B2 7/2010 Motegi et al.
7,758,675 B2 7/2010 Naito et al.
7,780,761 B2 8/2010 Gu et al.
7,815,719 B2 10/2010 McKinney et al.
7,833,322 B2 11/2010 Botvinnik et al.
7,857,884 B2 12/2010 Bohlen
7,857,890 B2 12/2010 Paterson et al.
7,896,957 B2 3/2011 Zhao et al.
7,914,604 B2 3/2011 Mello et al.
7,942,952 B2 5/2011 Gale
7,998,255 B2 8/2011 Blum
8,043,412 B2 10/2011 Carlson
8,049,426 B2 11/2011 Krichtafovitch et al.
8,092,768 B2 1/2012 Miller et al.
8,211,208 B2 7/2012 Chan et al.
8,241,396 B2 8/2012 Ursem et al.
8,241,397 B2 8/2012 Gu et al.
8,277,541 B2 10/2012 Hunt et al.
8,278,797 B2 10/2012 Sashida
8,349,052 B2 1/2013 Noh et al.
8,357,233 B2 * 1/2013 Chan ..... B03C 3/08 96/39
8,366,813 B2 2/2013 Tokuda et al.
8,388,900 B2 3/2013 Benedek et al.
8,404,020 B2 3/2013 Farmer et al.
8,414,687 B2 4/2013 Li
8,454,733 B2 6/2013 Tanaka et al.

(56) References Cited

U.S. PATENT DOCUMENTS 8,460,433 B2 6/2013 Gefter et al.
8,492,733 B1 7/2013 Klochkov et al.
8,506,674 B1 8/2013 Brown-Fitzpatrick et al.
8,551,228 B2 * 10/2013 Chan ..... B03C 3/08 96/81
8,574,345 B2 11/2013 Ursem et al.
8,597,415 B2 12/2013 Noh et al.
8,608,826 B2 12/2013 Al-Hamouz
8,608,838 B2 12/2013 Wong et al.
8,623,116 B2 1/2014 Karlsson
8,624,476 B2 1/2014 Sekoguchi
8,663,362 B2 3/2014 Hagan
8,690,996 B2 4/2014 Ji et al.
8,702,848 B2 4/2014 Kulprathipanja et al.
8,721,775 B2 5/2014 Chesebrough
8,736,043 B2 5/2014 Konno et al.
8,741,018 B2 6/2014 Belcher et al.
8,760,830 B2 6/2014 Ikeda
8,845,782 B2 9/2014 Metteer
8,873,215 B2 10/2014 Waddell
8,889,079 B2 11/2014 Zahedi
8,920,537 B2 12/2014 Seike
8,999,040 B2 4/2015 Johansson
9,028,588 B2 5/2015 Hess
9,089,849 B2 7/2015 Gu et al.
9,216,233 B2 12/2015 Ota et al.
9,308,537 B2 * 4/2016 Krichtafovitch ..... B03C 3/09
9,308,538 B2 4/2016 Genereux et al.
9,327,293 B2 5/2016 McKinney et al.
9,387,487 B2 7/2016 McGrath
9,441,845 B2 9/2016 Waddell
9,457,118 B2 * 10/2016 Ota ..... B03C 3/09
9,488,382 B2 * 11/2016 Krichtafovitch ..... B03C 3/08
9,550,189 B2 1/2017 Oertmann
9,630,186 B2 4/2017 Back
9,797,864 B2 10/2017 McKinney
2002/0134932 A1 9/2002 Guevremont et al.
2002/0152890 A1 10/2002 Leiser
2002/0190658 A1 12/2002 Lee
2003/0005824 A1 1/2003 Katou et al.
2003/0090209 A1 * 5/2003 Krichtafovitch ..... H01J 49/04 315/111.91
2003/0131727 A1 7/2003 Fissan et al.
2004/0023411 A1 2/2004 Fenn
2004/0105802 A1 6/2004 Duncan et al.
2006/0177356 A1 8/2006 Miller
2006/0185511 A1 8/2006 Tepper
2006/0278082 A1 12/2006 Tomimatsu et al.
2006/0286017 A1 12/2006 Hakka
2007/0148061 A1 6/2007 Lau et al.
2008/0030920 A1 2/2008 Krichtafovitch et al.
2008/0092743 A1 4/2008 Taylor et al.
2008/0121106 A1 5/2008 Tepper et al.
2008/0282772 A1 11/2008 Petinarides
2009/0114090 A1 5/2009 Gu et al.
2009/0235817 A1 9/2009 Gu et al.
2009/0235821 A1 9/2009 Mochizuki et al.
2009/0320426 A1 * 12/2009 Braunecker ..... B01D 46/0013 55/511
2010/0051709 A1 3/2010 Krichtafovitch et al.
2010/0095848 A1 4/2010 Chang et al.
2010/0229724 A1 9/2010 Tokuda et al.
2010/0236411 A1 * 9/2010 Chan ..... B03C 3/08 96/25
2010/0243885 A1 9/2010 Tepper et al.
2011/0084611 A1 4/2011 Schlitz et al.
2011/0286892 A1 11/2011 Taylor et al.
2012/0073436 A1 3/2012 Li
2013/0047857 A1 2/2013 Bohlen
2013/0047858 A1 2/2013 Bohlen et al.
2013/0047859 A1 2/2013 Bohlen
2013/0074690 A1 3/2013 Tomimatsu et al.
2013/0098247 A1 * 4/2013 Chan ..... B03C 3/08 96/80
2013/0220128 A1 8/2013 Gu et al.
2013/0284025 A1 10/2013 Johansson et al.
2014/0150659 A1 6/2014 McGrath
2014/0174294 A1 * 6/2014 Krichtafovitch ..... B03C 3/09 96/20
2014/0345463 A1 11/2014 Urata et al.
2014/0373717 A1 12/2014 Wang
2015/0013541 A1 1/2015 Vandenbelt et al.
2015/0059580 A1 3/2015 Clement et al.
2015/0246595 A1 * 9/2015 Forejt ..... B03C 3/011 96/57
2015/0260147 A1 9/2015 Schenk et al.
2015/0323217 A1 11/2015 Krichtafovitch
2015/0343454 A1 12/2015 Tyburk
2016/0013013 A1 1/2016 Waddell
2016/0184834 A1 6/2016 Genereux et al.
2016/0236205 A1 8/2016 Seeley et al.
2017/0008008 A1 1/2017 Umase
2017/0021363 A1 1/2017 Krichtafovitch
2017/0072406 A1 3/2017 Yamaguchi et al.
2017/0354977 A1 12/2017 Krichtafovitch
2017/0354979 A1 12/2017 Krichtafovitch
2018/0015482 A1 * 1/2018 Rothenberg ..... B03C 3/41

FOREIGN PATENT DOCUMENTS

CN 201210251 3/2009
CN 100552854 10/2009
CN 101657247 B 6/2013
CN 103706479 A 4/2014
CN 105034756 A 11/2015
CN 205066003 U 3/2016
DE 4114935 A1 11/1991
EP 0332624 B1 1/1992
EP 2700452 * 2/2014 ..... B03C 3/08
EP 2700452 A2 2/2014
GB 1490315 A 11/1977
WO 2010025811 A1 3/2010
WO 2012039826 A3 8/2012
WO 2013173528 A1 11/2013
WO 2015084112 A1 6/2015

* cited by examiner

ELECTROSTATIC AIR FILTER

BACKGROUND OF THE INVENTION

1. Field of the Invention

The present invention relates to electrostatic air filters and associated systems for cleaning gas flows. More particularly, the invention is related to electrostatic air filters for use in highly contaminated atmospheres.

2. Description of the Related Technology

Electrostatic air purifiers and conditioners are known and may utilize parts referred to as "corona" wire or "corona electrode", "collecting electrode", and barriers between these electrodes. The collector electrodes and or corona electrodes may be mounted and one or more sets of electrodes may be removable to facilitate cleaning. One of the functions of the barriers is to impair spark-over or creeping (along the surface) discharge between the electrodes.

It is also known to arrange an ion collecting member (Collecting cartridge or collecting electrode) and an ion emitting member (Corona electrode or corona frame) to be supported on the floor of the housing.

Known designs provide for electrodes to be attached flush to the walls of the housing in order to prevent dirty air from bypassing between the electrodes and the walls. Electrostatic air filters include electrodes at greatly different electrical potentials. The difference in voltage often approaches or exceeds 10 kV. The electrodes are typically mounted on a non-conductive structures in order to maintain electrical isolation between structures having high differences in potential.

A disadvantage of such designs is that electrically conductive matter which may enter into the housing with the air may settle on the barriers, the floor of the housing and/or on the walls including on the non-conducting structures between the electrodes. This disadvantage is more pronounced in environments that are characterized by chemically aggressive or electrically conductive matter.

Such an aggressive or conductive matter may contaminate non-conducting structures including plastic barriers and walls and makes them electrically conductive. The contamination may be difficult or even impossible to remove. Chemically aggressive contaminates may penetrate into a plastic body and change the physical properties of non-conductive materials (like ABS) to be semi-conductive. The contamination of the barriers and walls shortens the effective distance between the electrodes and may provoke an electrical discharge (spark or creeping discharge) between a corona wire and a collecting electrode.

In a device having non-conductive structures between electrical components having a high differential potential between the corona frame and the collecting cartridge is such that electrical discharge like spark or arcing between the electrodes takes place while the corona discharge occurs and ions are emitted from the corona electrode to the collecting electrode. When the barriers between these electrodes become semi-conductive the ions emitted from the corona wire may travel through the barrier surface. This ion flow constitutes an ionic current flowing from the corona electrode to the barrier. The barrier then assumes the electrical potential that is close to the electrical potential of the corona wire effectively shortening the gap D. The same event happens when particles settle on the walls between components at high potential differences.

In this event an electrical discharge may occur from the barriers' edges (or from the contaminated walls) to the collecting cartridge. This unfortunate event shortens the lifetime of electrostatic air conditioning systems when they are employed in certain geographical, industrial or climatic regions with chemically aggressive or electrically conductive contaminations present in the air.

Known corona frames may be made of electrically insulating material (plastic). Thin corona wires may be located on the frame. The wires are parallel to each other. The conductive wires meet and touch an electrically insulating material of the frame at the bottom and at the top of the corona frame. The electric field strength at the spot where two materials touch each other is substantially higher than in the middle part of the wires. Additional insulating barriers are installed on the frame to alleviate the electric field raise. These barriers are located at the side of the corona frame that is closest to the opposite electrodes.

The disadvantage of such design is the same as above, i.e., the dust, containing chemically aggressive or electrically conductive matter (vapor or particles), may enter into the air conditioner and settles on the corona frame barriers.

The ions emitted from the corona wire go to the edges of the corona frame barriers. When the barrier becomes semi-conductive, the barrier then assumes the electrical potential that is close to the electrical potential of the corona wire, effectively shortening the gap between the corona electrodes and the collector electrodes.

Therefore some "hissing" and even sparking may occur from the barrier edges (or from the contaminated walls) to the corona or collecting electrodes. Again, this unfortunate event shortens the lifetime of electrostatic air conditioning system that works in certain geographical, industrial or climatic regions where chemically aggressive or electrically conductive contaminations are common in the air.

Another drawback to existing corona frame designs is the wire vibration that occurs from time to time and which causes unpleasant noise, as well as may lead to the wire degradation and damage.

US Patent Publication No. 2014/0174294 shows an electrostatic air conditioner having at least one ion emitting member (i.e., corona frame) and at least one ion collecting member (i.e., collecting cartridge). The corona frame and collecting cartridge are configured to have active and passive areas and be removable from the housing within which they are positioned. The passive areas provide additional spacing between the active area and the side walls of the housing, and provide several advantages over existing electrostatic air conditioners, e.g., eliminates barriers between active corona wires and the housing walls, which prevents any settling of chemically active or electrically active matter (vapor or particles) on such barriers and/or housing walls (due to air flow).

Electrostatic air filters may have one or more stages. One-stage electrostatic air filters may contain a corona electrode and a collecting electrode. The collecting electrode may be flat or corrugated plates. When sufficient electrical potential difference on the order of kilovolts or tens of kilovolts is applied between the corona and collecting electrodes, a corona discharge may take place and ions are emitted from the corona electrodes. These ions travel with a stream of air toward the collecting electrodes. Dust particulates in the air become charged with the ions, and thus carry the electrical charge by themselves. When electrically charged particles reach the collecting electrodes, they settle there while clean air continues to pass further.

U.S. Pat. No. 2,526,402 shows an electrostatic air filter. The filter contains a plurality of collecting electrodes alternating with repelling electrodes. The collecting electrodes are assembled on a first set of conductive rods. The repelling electrodes are assembled and electrically connected to a second set of conductive rods attached to the repelling electrodes and to the case wall. There is an insulating structure electrically separating the collecting electrodes and repelling electrodes.

The rods are not electrically connected to the repelling electrodes. The rods do not have an electrical contact with the collecting electrodes. However, the creeping path between rods is along the surface of the insulating structure. When the insulating structure is clean, there is no electrical shortage between the first and second sets of conducting rods. When the insulating structure is dirty and contaminated with electrically conducive substances like metal powder or coal dust, it becomes slightly conductive. Due to high electrical potential difference between the rods, even a slightly conductive path may cause an electrical shortage.

FIGS. 1A and 1B schematically illustrate a prior art configuration 101 for mounting collecting electrodes 102 and repelling electrodes 103 in an electrostatic air cleaner modified after the design shown in U.S. Pat. No. 2,526,402. The configuration is a plurality of collecting electrodes 102 alternating with a plurality of repelling electrodes 103. The electrodes may be plate structures. Collecting electrodes 102 may be electrically connected to conducting rod 104. The repelling electrodes may include apertures 107 which surrounds, but does not touch, conducting rods 104. Repelling electrodes 103 may be electrically connected to conducting rod 105. The collecting electrodes 102 may include apertures 108 which surround but do not touch connecting rods 105.

The collecting electrodes 102 may be assembled on the conductive rods 104. These rods 104 may be attached to the collecting electrodes 102 and to the case wall 106. The repelling electrodes 103 are assembled by the conductive rods 105. These rods 105 are attached to the repelling electrodes 103 and to the case wall 106. The case wall 106, or at least part of it, is made of non-conductive material like ABS plastic or porcelain.

The rods 104 do not have an electrical contact with the repelling electrodes 103. The rods 105 do not have an electrical contact with the collecting electrodes 102. The creeping path between these rods may be established along the insulating surface of the case wall 106. When the wall 106 is clean, no electrical shortage between the rods 104 and 105 takes place. When the wall is dirty and contaminated with electrically conductive substances like metal powder or coal dust, the surface may become slightly conductive. Due to high electrical potential difference between the rods 104 and 105, even a slightly conductive path may cause an electrical shortage. The creeping distance in the configuration illustrated in FIGS. 1A and 1B is shown as "a."

Two-stage electrostatic air filters may have four types of electrodes. Corona electrodes and exciting electrodes form an ionization stage located at the air inlet. The exciting electrodes may be at or near ground potential. An electrical potential difference of several kilovolts or tens of kilovolts may be applied between the corona electrode and the exciting electrode in order to generate a corona discharge. A collecting stage may be downstream of the ionization stage and may include collecting and repelling electrodes. The collecting electrodes may be flat or corrugated plates parallel to each other and spaced from each other. The repelling electrodes may be flat or corrugated plates parallel to each other and located between the collecting electrodes. The collecting electrodes may be at or near ground voltage. The electrical potential difference of tens of kilovolts may be applied between the collecting and repelling electrodes. The electric field is therefore formed in the area between the collecting and repelling electrodes. Ions are emitted by the ionization stage. The ions may charge particles passing through this stage toward the collecting electrodes. When charged particles enter the area between the collecting and repelling electrodes, these particles are attracted toward the collecting electrodes by the electric force between those electrodes, and settle on the collecting electrodes.

Corona discharge between the corona electrode and the exciting electrode may generate so called ionic wind. It may be beneficial to place the corona electrodes at the inlet side of the electrostatic air filter and the exciting electrode further down along with air passing. That arrangement may accelerate air and assist fans or blowers with air movement.

All of the electrodes described above are attached to corresponding rigid fixtures. The corona electrodes, for instance, may be attached to a corona frame. The collecting electrodes as well as the repelling electrodes may be attached to their own rigid fixtures. Those rigid fixtures are, in turn, attached to a common case (or a cabinet). As an alternative, all or some of the above mentioned electrodes may be attached to a common case (or a cabinet). This common case is made from an insulating material, like plastic.

When electrodes having different electrical potentials are attached to the cabinet directly or via the corresponding rigid fixtures, the shortest distance between them along an insulating surface is called the "creeping path." An electrical shortage between the electrodes may occur when this creeping path is short or becomes contaminated with electrically conductive substances such as metal powder or coal dust.

That phenomenon may lead to a power supply shortage or a failure, which may disrupt the operation of the electrostatic filter. Under certain conditions, i.e., when the incoming air contains conductive substances such as metal powder or coal dust, the electrostatic filters should be cleaned more often. This causes inconvenience and increases the cost of operation. In more harsh conditions, electrostatic air filters may not be useful at all.

An electrostatic air filter may have a case with walls and having an open air inlet and an open air outlet. The electrostatic air filter may have at least two electrode sets having different electrical potentials. Each electrode set may be assembled on a separate rigid fixture. The rigid fixtures may be secured to the case at separate spots. The separate spots may be spaced apart sufficient to establish an extended creeping distance. The electrode sets may be two or more of a collecting electrode set; a corona electrode set; an exciting electrode set; and a repelling electrode set. The collecting electrode set may have a plurality of collecting surfaces mounted parallel to each other and substantially parallel to a principal air flow direction. Repelling electrode sets may have a plurality of repelling surfaces mounted parallel to each other and in locations flanked by collecting surfaces. A corona electrode set may have one or more thin conductive wires mounted to traverse and air flow path in parallel and defining a plane that is substantially perpendicular to a principal air flow direction. An exciting electrode set may be one or more electrically conductive members in a plane that is parallel to a plane defined by a corona electrode set. The exciting electrode set may be an electrically conductive air penetrable web. The repelling electrode set may be at or near the electrical potential of the corona electrode set. The collecting electrode set may have an electrical potential at or near the electrical potential of the exciting electrode set. The collecting electrode set and the exciting electrode may have an electrical potential close to ground.

An electrostatic air filter may have an electrode assembly built upon an accordion rack. A first group of electrodes may be mounted in parallel on the accordion rack, and a second group of electrodes which operate at a different potential than the first group of electrodes may be mounted in parallel to the first group on the accordion rack wherein said electrodes are mounted in an alternating sequence. The accordion rack may have members secure to each other at pivot points to form the accordion rack. Some or all of the members may extend beyond the pivot points. An additional electrode set may be mounted on extended portion of the extended members.

In one configuration the collecting electrodes may have apertures and are connected to each other via rigid fixtures. The repelling electrodes may have apertures and may connect to each other via rigid fixtures. The repelling and collecting electrodes may be mounted in alternating order and parallel to each other. The rigid fixtures holding the collecting electrodes may be through rod-like members that pass apertures of the repelling electrodes but do not contact the repelling electrodes. In a similar fashion the rigid fixtures holding the repelling electrodes pass through apertures in the collecting electrodes but do not touch the collecting electrodes. The case may have two inner walls and two outer walls on opposing sides. These walls may be substantially parallel to the collecting electrodes and separated from each other by air gaps. The inner walls have apertures and the rigid fixtures of the collecting electrode set pass through the apertures of an inner wall on one side and may be secured to the outer wall on that same side. The fixtures for the repelling electrodes may pass through apertures in the inner wall on the opposing side and may be secured to the outer wall on that opposing side. When a rod or fixture is described as passing through an aperture of an electrode, it is intended that the rod or fixture does not contact that electrode.

Another mechanism that may be employed to hinder accumulation of conductive and/or semi-conductive particles is the use of a shield to block or reduce airflow in areas where it is critical to impair buildup and hinder creep. Yet another mechanism may be employed to that end which replaces flat elements that may be subject to particle accumulation with irregular, winding, or corrugated structures.

SUMMARY OF THE INVENTION

An electrostatic precipitator may have several types of electrodes. One type of electrode is a corona electrode. Another type may be collecting electrodes. There may be other types of electrodes such as an exciting electrode and a repelling electrodes. Each type of electrode referred to herein may be a single electrode or plural electrodes. Typically electrodes of the same type are kept at the same potential. The exciting electrode may be a single piece structure or more than one piece electrically connected to each other. A device may have corona electrodes. The corona electrodes may be a corona wire routed across the air flow path one time or more than one time and an electrostatic device may have one corona wire or multiple corona wires routed across an airflow path and electrically connected to each other. The term "electrode set" is intended to include one or more electrodes.

Electrodes that are under the same electrical potential may be attached to a common rigid fixtures or to a common case at or near the maximum available distance along the surface from each other. The surface separating the rigid fixtures from each other may be made winding or corrugated or convoluted in order to increase the creeping discharge path. The surface separating the electrodes from each other may be protected from contamination by particulate matter. Various objects, features, aspects, and advantages of the present invention will become more apparent from the following detailed description of preferred embodiments of the invention, along with the accompanying drawings in which like numerals represent like components.

Moreover, the above objects and advantages of the invention are illustrative, and not exhaustive, of those that can be achieved by the invention. Thus, these and other objects and advantages of the invention will be apparent from the description herein, both as embodied herein and as modified in view of any variations which will be apparent to those skilled in the art.

DETAILED DESCRIPTION OF THE PREFERRED EMBODIMENT

Figure 1A:
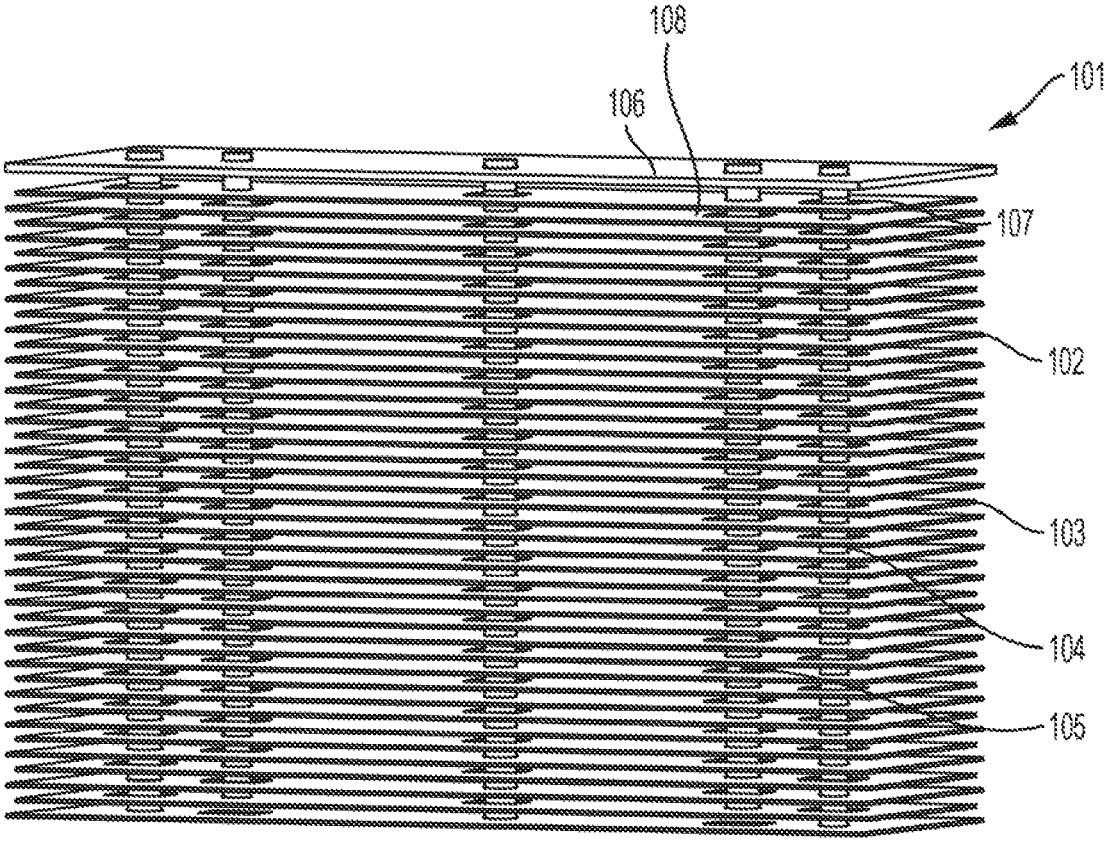
FIG. 1A PRIOR ART
FIG. 1A shows a schematic illustration of a prior art electrode configuration.

Before the present invention is described in further detail, it is to be understood that the invention is not limited to the particular embodiments described, as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range is encompassed within the invention. The upper and lower limits of these smaller ranges may independently be included in the smaller ranges is also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein.

It must be noted that as used herein and in the appended claims, the singular forms "a", "an", and "the" include plural referents unless the context clearly dictates otherwise.

All publications mentioned herein are incorporated herein by reference to disclose and describe the methods and/or materials in connection with which the publications are cited. The publications discussed herein are provided solely for their disclosure prior to the filing date of the present application. Nothing herein is to be construed as an admission that the present invention is not entitled to antedate such publication by virtue of prior invention. Further, the dates of publication provided may be different from the actual publication dates, which may need to be independently confirmed.

The invention is described in detail with respect to preferred embodiments, and it will now be apparent from the foregoing to those skilled in the art that changes and modifications may be made without departing from the invention in its broader aspects, and the invention, therefore, as defined in the claims, is intended to cover all such changes and modifications that fall within the true spirit of the invention.

The term "creeping distance" is used to indicate the distance between the two closest points on the surface of an insulated structures between components having different potentials, for example corona electrodes and collecting electrodes. The term "creeping path" is used to indicate the path of current flow on the surface of an insulated structure between components having different potentials, for example corona electrodes and collecting electrodes. The creeping path is no shorter than the creeping distance as the creeping path is the actual current path and the creeping distance is a measure of the minimum distance along a surface between two points.

An electrostatic air filter may have several groups of electrodes. All electrodes in a group have the same or similar electrical potential. The electrical potential difference between the groups of electrodes may be ranged from several kilovolts to several tens of kilovolts.

Corona electrodes in an electrostatic air cleaner may be in the form of thin wires and may be located on a corona frame. The collecting electrodes may be secured on common rigid fixture. Sets of rods or brackets may be used to mount the collecting electrodes.

Electrodes that belong to the same group may be secured on a common rigid fixture. The rigid fixtures may be secured, integrated with, or attached to a non-conductive case in a manner where the attachment points for rigid fixtures that support the electrodes under different electrical potentials are spaced apart from each other along the surface of the case. The spacing may be selected to increase the creeping distance between electrodes of differing potentials. The spacing may be greater than the minimum spacing otherwise permitted FIGS. 2A, 2B, 2C, 2D, and 2E show an electrostatic air filter 201 with a case 202. The case 202 may be non-conductive and may have two horizontal and two vertical walls attached to each other. The electrostatic air filter 201 may have a corona electrode frame 203 with parallel thin wires, an exciting electrode 204 with an air penetrable electrically conductive web, collecting electrodes 205 which may be secured by four brackets 208 to vertical walls 206 of the case 202, and repelling electrodes 209 which may be received in slots 213 provided in horizontal walls 210 of the case 202. The exciting electrode 204 may be secured to the case 202 by brackets 208. The brackets 208 may be attached to the vertical walls of the case 202 with latches 211, 212. The exciting electrode 204 may be grounded or at a low (i.e., safe) electrical potential. The exciting electrode 204 may also serve as an electrical protection for people and as a rough pre-filter at the same time. The exciting electrodes 204 may be located on upstream or downstream side of the corona electrode 203.

The exciting electrode 204 fixture may be attached to opposing parallel walls of the case, for example, at the vertical walls. The corona wires may be under high electrical potential in the order of several kilovolts to several tens of kilovolts. Therefore, the corona electrode 203 fixture may be attached to orthogonal walls, for example, the horizontal walls of the case 202. Such a configuration provides an extended creeping path from the corona electrode frame 203 to the exciting electrode frame 204 via the surface of the case 202.

The repelling electrodes 209 may be located between the collecting electrodes 205 and may be parallel to each other. The repelling electrodes 209 may be attached to the horizontal plates of the case 202 by the slots 213. The repelling electrodes may be under high electrical potential that is close to or, in some instances, the same as the electrical potential on the corona electrode wires. Therefore there is no need to separate the corona electrode frame 203 and the repelling electrodes 209 by a long creeping path.

The collecting electrodes 205 may be secured by the brackets 208. The collecting electrodes 205 may be located between the repelling electrodes and may be parallel to each other. The collecting electrodes 205 may be under a low electrical potential that is close to the electrical potential of the exciting electrodes 204. The collecting electrodes 205 may be separated from the horizontal walls of the case by air gaps.

The brackets 208 may hold the collecting electrodes 205 and may be secured to the vertical walls of the case 202, while the repelling electrodes 209 may be attached to the horizontal walls. Such an arrangement ensures an extended creeping path along the surface between the collecting electrodes 205 and the repelling electrodes 209.

The shortest distance for the creeping discharge is from the outmost repelling electrodes 209 via part of the horizontal wall of the case 202, then via part of the vertical wall of the case 202, and finally via part of the brackets 208 to the outmost collecting electrodes 205. This path is much longer than it would be if the collecting electrodes and the repelling electrodes were both supported by the horizontal wall of the case 202 like in the existing art.

Another feature further prevents a creeping discharge between the electrodes that are under different electrical potentials. The surfaces connecting such electrodes may be made winding or corrugated or convoluted in the same manner as surfaces of outdoor electrical insulators in transmission lines. That feature, along with the arrangement described above, ensures an even longer path for the creeping discharge along the surface.

Figure 3A:
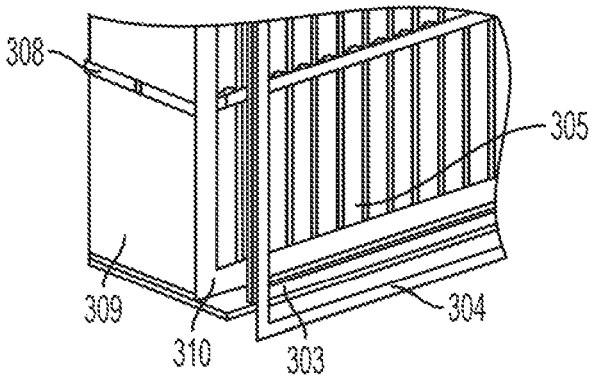
FIGS. 3A and 3B show a partial view of a filter with an inlet exciting electrode and corona wires located on the frame.
Figure 3B:
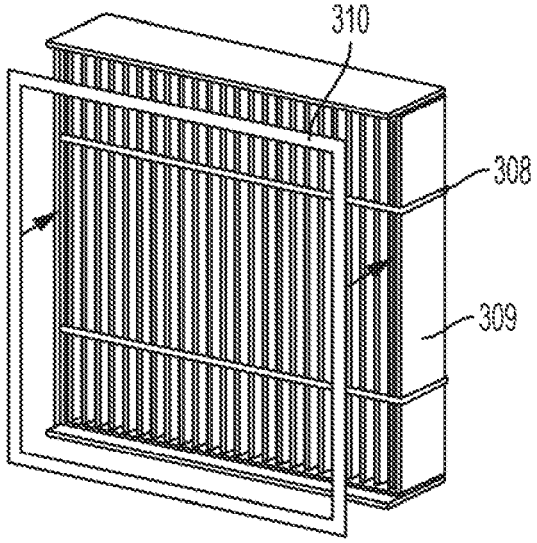

FIGS. 3A and 3B show a partial view of a filter with an inlet exciting electrode 304 and corona wires located on the frame 303. A protecting shield 310 may be provided to impair, deflect, or block air passage along the walls of the case 202. This reduces the amount of particulate that will settle and contaminate the walls of the filter case 202.

The collecting electrodes 205 may advantageously be located on a separate fixture, i.e., on the brackets 208 or 308. When the collecting electrodes 205 (305 in the FIG. 3)

become contaminated, the whole collecting electrodes assembly may be removed from the case 202. Usually, the distance between the neighboring electrodes is larger than the thickness of the electrodes. In this case, two or more collecting electrodes assemblies may be inserted into each other. This way, they occupy much less space. A consumer or a customer, therefore, would enjoy cost and space savings on shipment and storage.

Figure 1B:
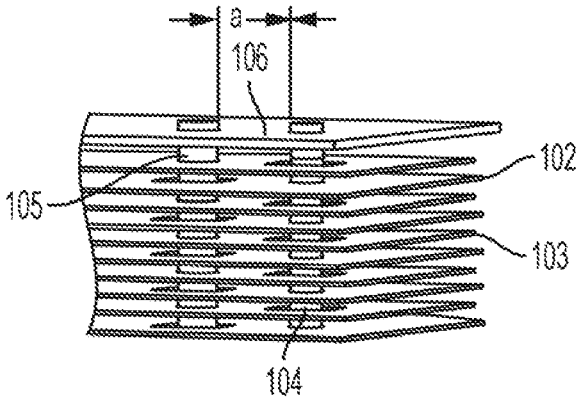
FIG. 1B PRIOR ART
FIG. 1B shows a portion of FIG. 1A enlarged.
Figure 2A:
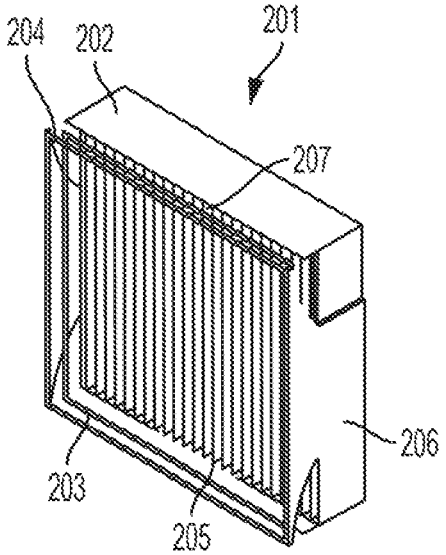
FIGS. 2A, 2B, 2C, 2D and 2E show an electrostatic filter with a case.
Figure 2B:
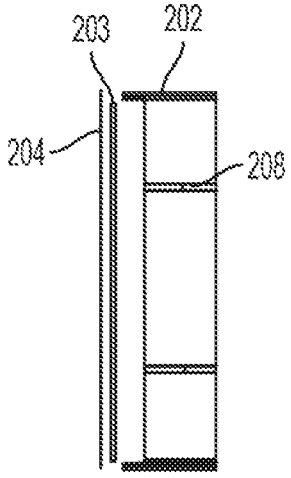
Figure 2C:
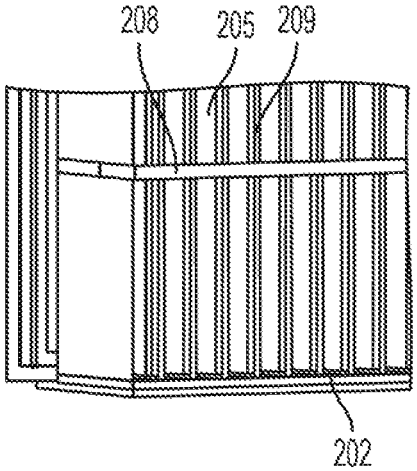
Figure 2D:
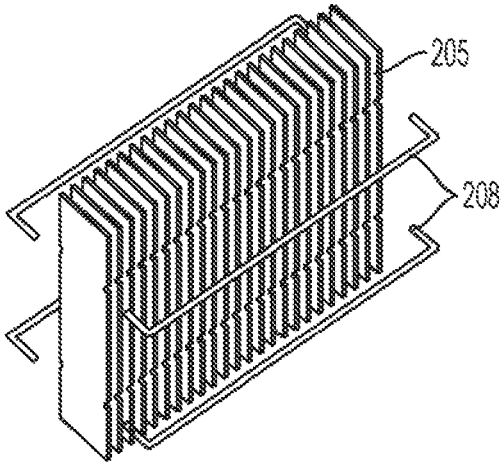
Figure 2E:
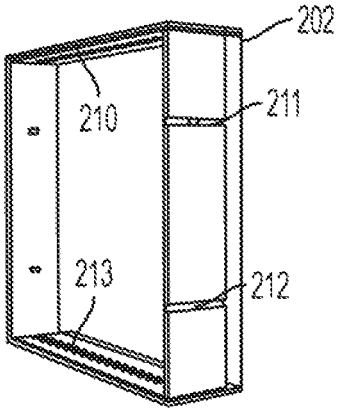
Figure 4A:
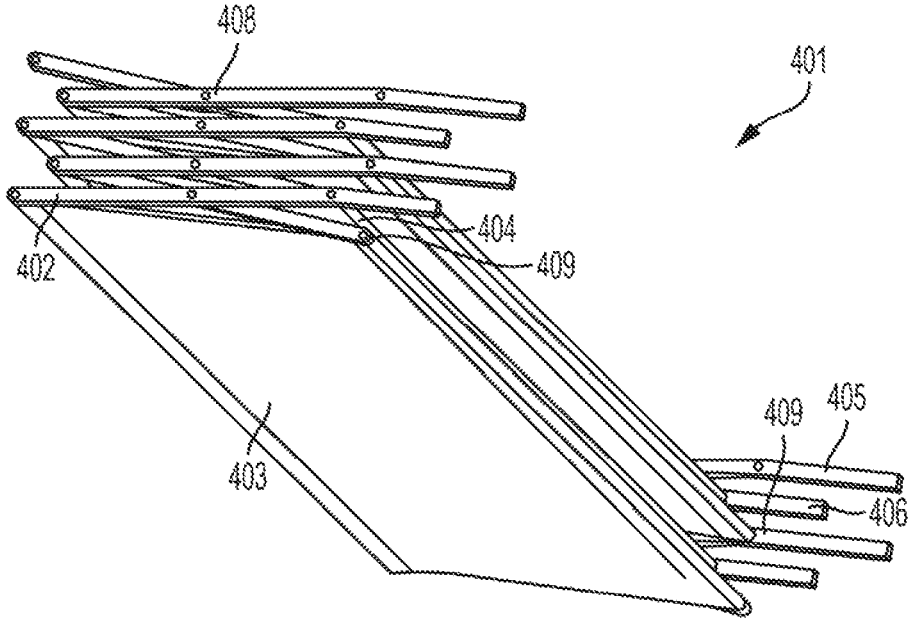
FIGS. 4A and 4B show a second embodiment of an electrostatic filter.
Figure 4B:
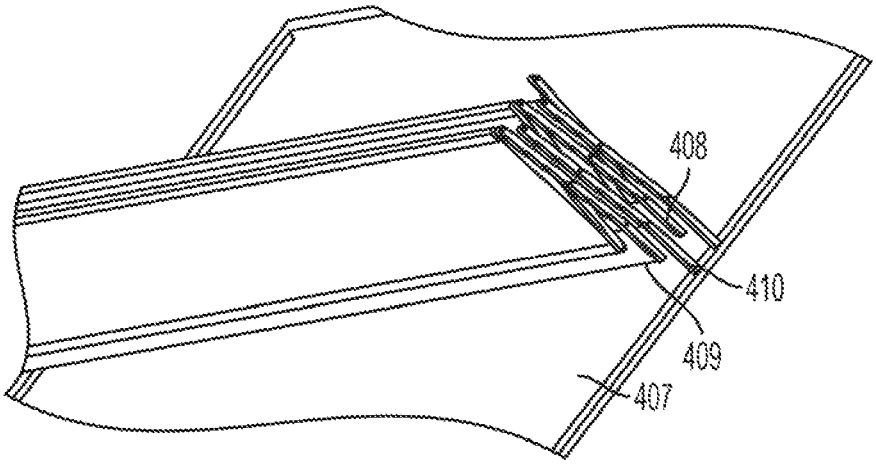

FIGS. 4A and 4B show a second embodiment of an electrostatic filter. The electrostatic air filter 401 may contain collecting electrodes 403 and the repelling electrodes 404. The collecting electrodes 403 and the repelling electrodes 404 may be assembled on an accordion rack 402. The accordion rack may be constructed of folding bars connected at middle pivot points 408 and edge pivot points 409. The collecting electrodes 403 and repelling electrodes 404 may be secured at the edge pivot points 409 of the bars of the accordion rack 402. The bars may have shorter extensions 405 and longer extensions 406. The exciting electrode 407 may be a conductive web similar to 204 in the FIG. 1 and may be attached to the longer extensions. The corona electrodes (not shown) may be similar to electrodes 203 in FIG. 1 and may be attached to the shorter extensions 406. Alternatively, the corona electrodes may be attached to the longer extensions 405 while the exciting electrode may be attached to the shorter extension 406.

In the configuration shown in FIGS. 4A and 4B, the distance, along any structural component between collecting electrodes 403 and adjacent repelling electrodes 404 may be substantially greater than the space between the collecting electrodes 403 and adjacent repelling electrodes 404. The shortest creeping path therebetween requires traversal of the folding bars.

As a practical example, assuming that the width (along the air flow direction) of the collecting electrode 403 is equal to 200 mm and the width of the repelling electrode 404 is equal to 180 mm, then the creeping path along the bars is approximately 150 mm. At the same time, the electrodes are separated from each other by about 10 mm. The arrangement shown in FIGS. 4A and 4B increases the creeping path by about 15 times compared with the shortest distance between the electrodes through the air.

Figure 5A:
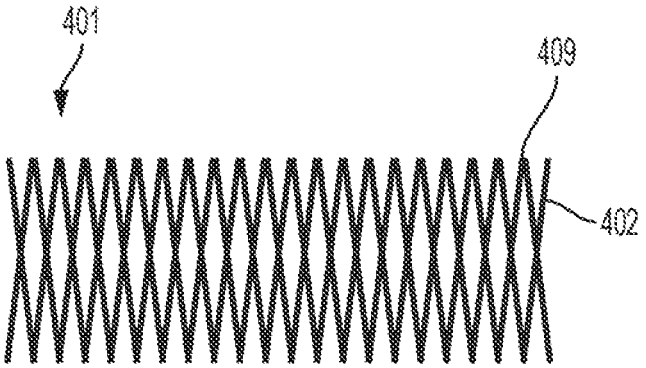
FIGS. 5A and 5B show the top view of an electrostatic filter in unfolder and folded configurations.
Figure 5B:
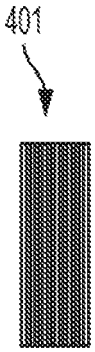

The arrangement shown in the FIGS. 4A and 4B has still another advantage over the existing art. It is foldable. FIG. 5A shows a top view of an electrostatic air filter in an unfolded (operational) configuration. FIG. 5B shows a top view of an electrostatic air filter in a folded (stored) configuration. The unfolded configuration, shown in FIG. 5A may be about 530 mm (left to right), while the folded configuration shown in FIG. 5B may occupy just 63 mm. This is more convenient for filter maintenance (replacement) and also presents an advantage in cost savings for shipment and storage of the electrostatic air filter parts. In order to facilitate deployment of the electrodes, the pivots may have some sliding clearance and mechanism for locking the plate in the deployed (or open) position of the folding bars/pivot points.

FIGS. 6A, 6B, 6C, 6D and 6E show an alternative electrode support configuration for increasing the creeping path length and has substantially improved filter performance in dirty atmospheres.

The electrostatic air filter 601 may contain a plurality of collecting electrodes 602 with apertures 608 and a plurality of repelling electrodes 603 with apertures 609. The collecting and repelling electrodes may alternate. The collecting electrodes 602 may be assembled with the conductive rods 604. These rods 604 may be attached to the collecting electrodes 602 and to the case wall 607. The repelling electrodes 603 may be assembled on conductive rods 605. Rods 605 may be attached to repelling electrodes 603 and to the case wall 606. The case walls 606 and 607 may be made of non-conductive material like ABS plastic.

The rods 604 are not electrically connected to repelling electrodes 603 and the rods 605 are not electrically connected to collecting electrodes 602. Therefore, the creeping path does not exist here. However, the creeping path is along the surface of the case wall 606 and 607. The rods 604 may pass through an aperture 610 in the walls 606. Aperture 610 may have a diameter greater than the diameter of the rod 604. Therefore, there is no electrical contact between the collecting electrodes 602 and the wall 606. The same provision may be provided for the rods 605 with apertures 608 and rods 604 with apertures 609.

Figure 6A:
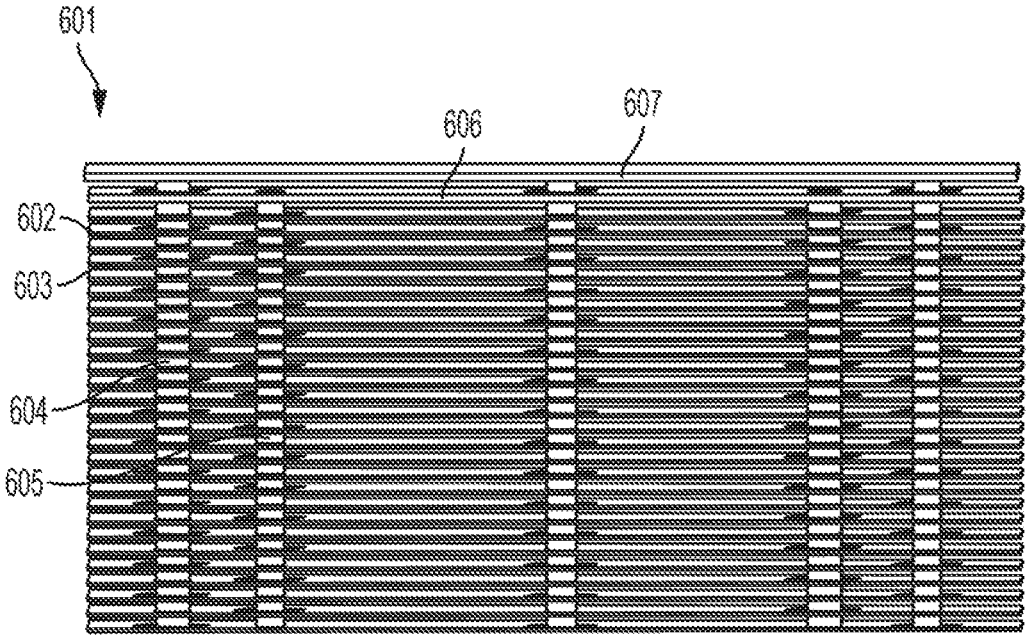
FIGS. 6A, 6B, 6C, 6D and 6E show an alternative electrode support configuration.
Figure 6B:
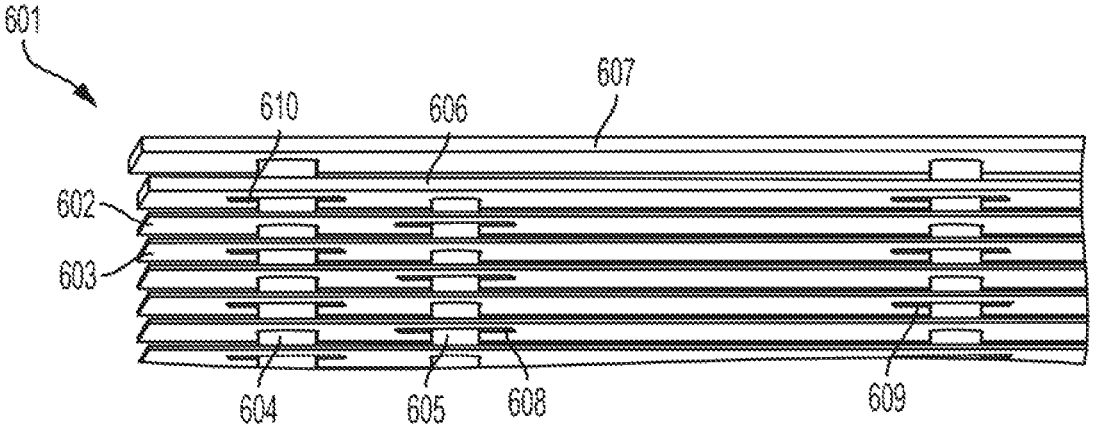
Figure 6C:
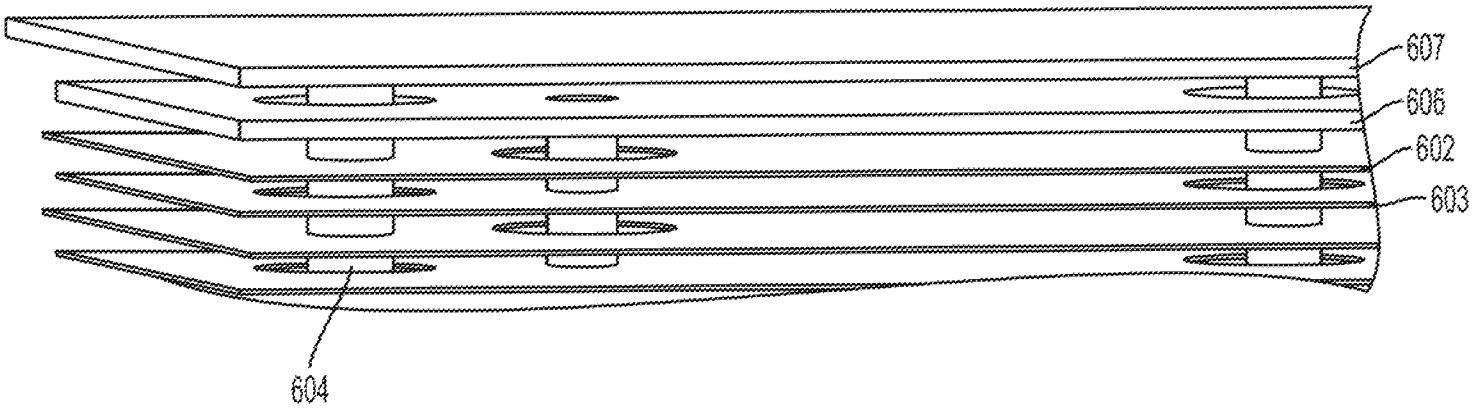
Figure 6D:
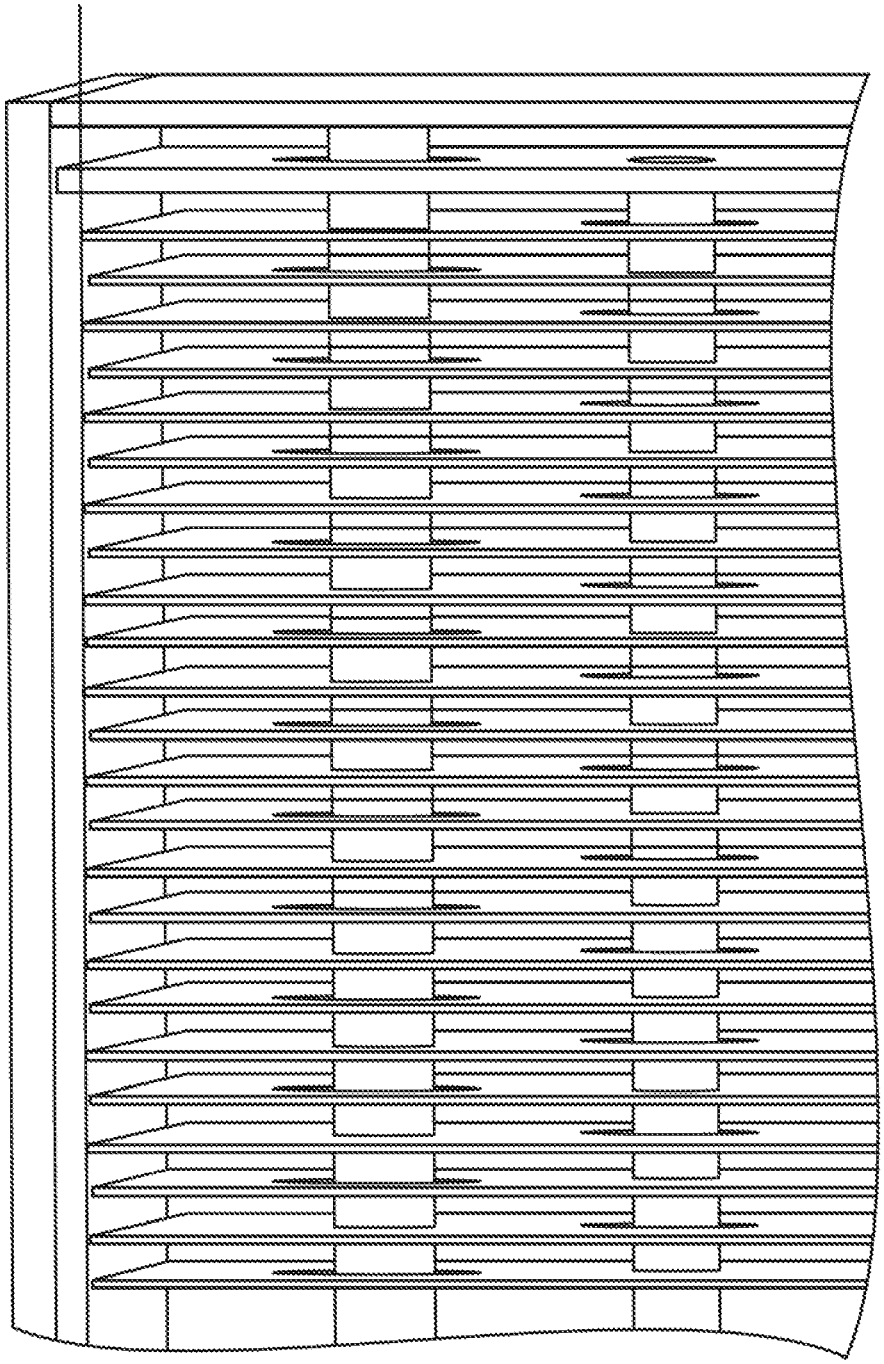
Figure 6E:
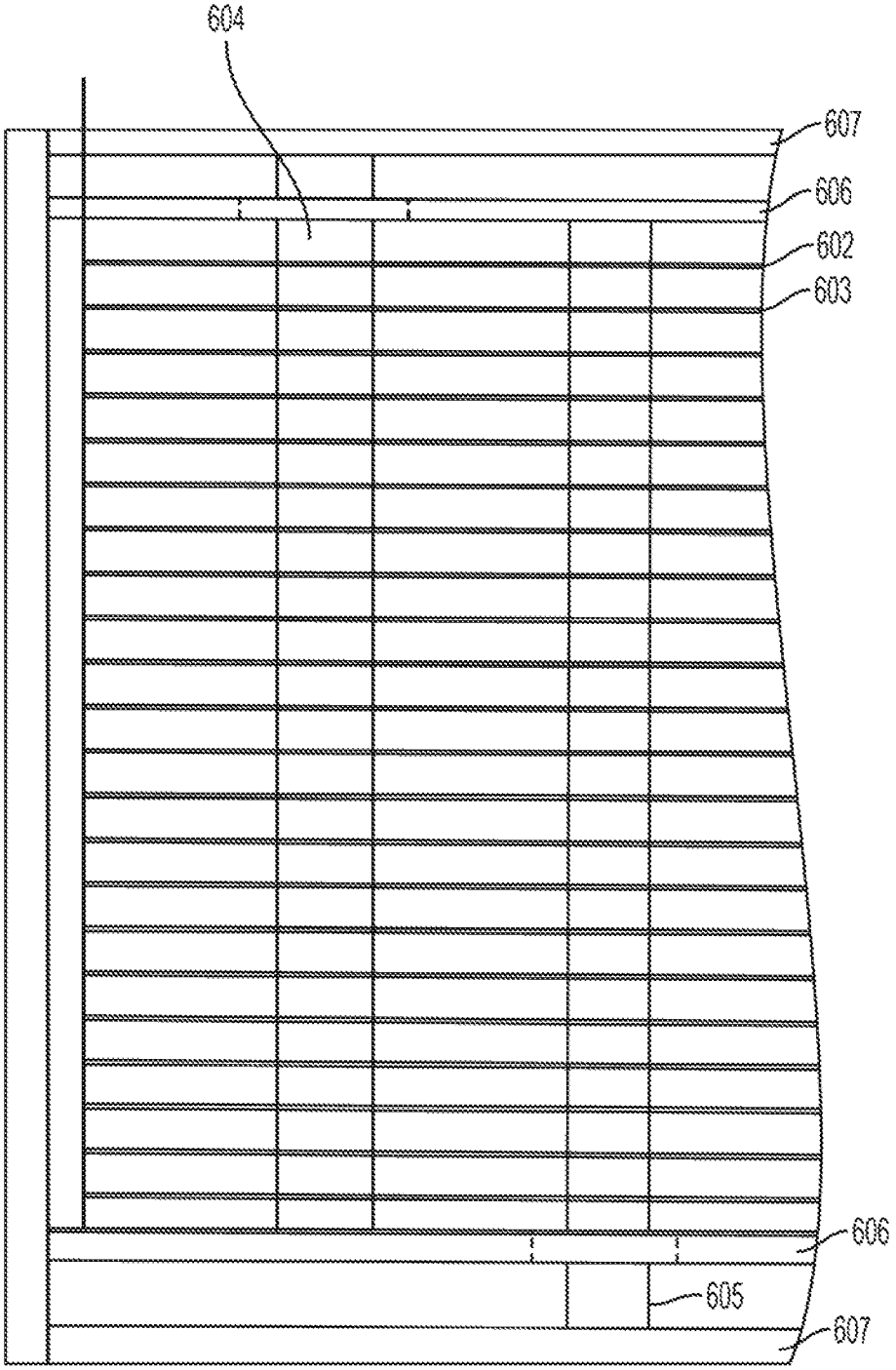

The creeping path between the collecting electrodes 602 and the repelling electrodes 603 may be substantially greater than in the existing art. The creeping path in the embodiment shown in FIGS. 6A and 6B is from the rod 605 along the wall 606 all way to the vertical wall of the case (not shown), then up along the vertical wall, and then back along the wall 607 to the place where the rod 604 is secured to the wall 607. In addition, the electrostatic air filter may be equipped with a protecting shield similar to shield 310 shown in FIG. 2. In addition, the creeping path may be further increased by forming walls 606 and 607 with a corrugated shape.

The techniques, processes and apparatus described may be utilized to control operation of any device and conserve use of resources based on conditions detected or applicable to the device.

Thus, the specific systems and methods for the electrostatic air filter have been disclosed. It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure, all terms should be interpreted in the broadest possible manner consistent with the context. In particular, the terms "contains" and "containing" should be interpreted as referring to members, or components in a non-exclusive manner, indicating that the referenced elements and components, may be present, or utilized, or combined with other members and components that are not expressly referenced.

The invention claimed is:

1. An electrostatic air filter comprising:

a case formed by walls and having an open air inlet and an open air outlet;

a first electrode set having a first electrical potential assembled on a first rigid fixture;

a second electrode set having a second electrical potential different from said first electrical potential and assembled on a second rigid fixture separate from said first rigid fixture;

said first rigid fixture is mounted to said case at a first set of spots and said second rigid fixture is mounted to said case at a second set of spots;

wherein said first set of spots is spaced from said second set of spots by an extended creeping distance; and wherein said first electrode set is a collecting electrode set and said collecting electrode set comprises a plurality of collecting electrodes mounted parallel to each other and substantially parallel to a principal air flow direction;

wherein said second electrode set is a repelling electrode set and said repelling electrode set comprises a plurality of repelling electrodes mounted parallel to each other, substantially parallel to a principal airflow direction and interleaved with said plurality of collecting electrodes;

wherein said collecting electrodes have collecting electrode apertures and said repelling electrodes have repelling electrode apertures;

wherein said first rigid fixtures go through said repelling electrode apertures without touching said repelling electrodes;

wherein said second rigid fixtures go through said collecting electrode apertures without touching said collecting electrodes;

wherein said walls include a first inner wall and a first outer wall generally parallel to said principal airflow path on a first side of said case and said first inner wall and said first outer wall are positioned to define an air gap there between;

wherein said walls include a second inner wall and a second outer wall generally parallel to said principal airflow path on a second side of said case opposing said first side of said case and said second inner wall and said second outer wall are positioned to define an air gap there between;

said first inner wall and said second inner wall have one or more apertures;

said first rigid fixtures are secured to said first outer wall on said first side of said case and go through apertures in said first inner wall without touching said first inner wall and said first rigid fixtures are connected to said second inner wall;

said second rigid fixtures are secured to said second outer wall on said second side of said case and go through apertures in said second inner wall without touching said second inner wall.

2. The electrostatic air filter according to claim 1 wherein one or more of said walls is corrugated.

3. The electrostatic air filter according to claim 1 wherein a surface of at least one of said first rigid fixture and said second rigid fixture is corrugated.

4. The electrostatic air filter according to claim 1 further comprising a shield positioned to block said air gaps.

5. An electrostatic air filter electrode assembly comprising:

an accordion rack;

a first group of electrodes mounted in parallel on said accordion rack; and a second group of electrodes which operate at a different potential than the first group of electrodes mounted in parallel on said accordion rack;

wherein said first group of electrodes are mounted in an alternating sequence with said second group of electrodes;

wherein said accordion rack further comprising lateral supports each having a plurality of members connected in an accordion fashion at middle pivot points and edge pivot points; and wherein at least some of said members include extended portions which extend beyond said edge pivot points; and further comprising corona electrodes mounted on said extended portions.

6. The electrostatic air filter according to claim 1 wherein said walls include a first set of parallel walls and a second set of parallel walls; and said first rigid fixture is mounted to said first set of parallel walls and not in contact with said second set of parallel walls and said second rigid fixture is mounted to said second set of parallel walls and not in contact with said first set of parallel walls.

* * * * *